United States Patent [19]

Makino et al.

[11] Patent Number: 4,743,313

[45] Date of Patent: May 10, 1988

[54] AMORPHOUS ALLOY FOR USE IN MAGNETIC HEADS

[75] Inventors: Akihiro Makino; Mikio Nakashima, both of Nagaoka; Tadashi Sasaki, Koide; Koichi Mukasa, Nagaoka, all of Japan

[73] Assignee: Alps Electric Co., Ltd., Japan

[21] Appl. No.: 797,238

[22] Filed: Nov. 12, 1985

[30] Foreign Application Priority Data

Nov. 12, 1984 [JP] Japan ..... 59-236731
Apr. 20, 1985 [JP] Japan ..... 60-83601
Jun. 10, 1985 [JP] Japan ..... 60-124161

[51] Int. Cl.[4] ..... C22C 19/07
[52] U.S. Cl. ..... 148/403; 148/304; 148/305
[58] Field of Search ..... 148/403, 408, 425, 304, 148/305

[56] References Cited

U.S. PATENT DOCUMENTS 3,856,513 12/1974 Chen et al. ..... 148/403

*Primary Examiner*—R. Dean
*Attorney, Agent, or Firm*—Guy W. Shoup

[57] ABSTRACT

An amorphous alloy for use in magnetic heads having the following composition formula:

$$(Fe_{1-a}, Co_a)_{100-b}(Si_c,B_d)_b$$

where
a=0.93–0.95
b=23–27 atomic %
c/c+d)=0.55–0.65.

Cr and Ru may be desirably added to the amorphous alloy for improving the corrosion and abrasion resistance. Further, secondary phase particles may be dispersed in the alloy matrix for improving the effective magnetic permeability, particularly, at high frequency region.

5 Claims, 6 Drawing Sheets

AMORPHOUS ALLOY FOR USE IN MAGNETIC HEADS

BACKGROUND OF THE INVENTION

1. Field of the Invention

This invention concerns a magnetic alloy for use in magnetic heads and, particularly, it relates to an amorphous alloy main composed of Co for use in magnetic heads.

2. Description of Prior Art

Crystalline metal materials such as permalloy and sendust, as well as oxide materials such as Mn-Zn ferrite and Ni-Zn ferrite have mainly been used for magnetic head materials. Although crystalline metal materials have a saturation magnetic flux density higher than that of ferrite (oxide materials), since the specific resistivity of the former can be under 100 $\mu\phi$.cm, the magnetic permeability is very low in the frequency region used in video tape recorders or the like (MHz order).

On the other hand, since ferrites have a high specific resistivity, exhibit excellent electromagnetic conversion properties in the higher frequency region and, further, show an excellent abrasion resistance, Mn-Zn type ferrites have been used mainly for video heads. However, ferrites have low saturation magnetization, which results recording distortion and increased noise.

In the high density recording, a high frequency band is generally used. Accordingly, it is necessary to form the core materials used in high density magnetic heads into a thin film or the specific resistivity $\rho$ thereof needs to be increased in order to prevent degradation of the magnetic permeability due to eddy current loss. Although sendust material has a large saturation magnetization and higher specific resistivity as compared with that of permalloy, it is fragile and, accordingly, can not be formed into a thin film.

Recently, excellent magnetic and mechanical properties have been found in amorphous alloys having no crystalline structure. That is, since the amorphous alloys have no crystalline structure, their specific resistivity $\rho$ is several times higher than crystalline metal alloys and they have low coercive force and high magnetic permeability due to the absence of crystal magnetic anisotropy. Further, the Vickers hardness is about 1000, which is higher than that in crystalline metals.

Furthermore, a composition capable of reducing magnetic distortion to near zero has almost been formulated and a study has now been made on how to apply it in magnetic head core materials.

However, in using such amorphous alloys in magnetic head cores for use in the high density recording, it is necessary that they have a high magnetic permeability in the high frequency region above 1 MHz as well as in the lower frequency region. In view of the above, it is necessary to satisfy the following requirements:

(1) high specific resistivity,
(2) high initial magnetic permeability,
(3) high abrasion resistance,
(4) high thermal stability,
(5) high corrosion resistance.

The present inventors have found that amorphous alloys capable of satisfying all of the foregoing requirements (1) through (5) occur within an extremely narrow composition region.

This invention discloses such a composition region capable of satisfying all of the above requirements 1 through 5, in an amorphous alloy consisting essentially of four elements, Co, Fe, Si and B, to which Cr is added for providing corrosion resistance and Ru is added for improving abrasion resistance and in which secondary phase particles are dispersed throughout the alloy matrix.

OBJECT OF THE INVENTION

It is accordingly an object of this invention to provide an amorphous alloy having a high initial magnetic permeability, showing a higher magnetic permeability than that of ferrites even in a region higher than 1 MHz due to the higher specific resistivity, as well as exhibiting excellent abrasion resistance and high thermal stability.

SUMMARY OF THE INVENTION

The foregoing object of this invention can be attained by an amorphous alloy for use in magnetic heads having the following composition formula:

$$(Fe_{1-a}, Co_a)_{100-b}(Si_c,B_d)_b$$

where a=0.93−0.95
b=23–27 atomic %
c/(c+d)=0.55–0.65.

BRIEF DESCRIPTION OF THE ACCOMPANYING DRAWINGS

The foregoing and other objects, features and advantages of this invention will be made clearer by the following description in conjunction with the accompanying drawings, wherein FIG. 1 is a diagram showing the relationship between the specific resistivity $\rho$ and Si/Si+B(=c/c+d) in amorphous alloy;

DESCRIPTION OF THE PREFERRED EMBODIMENT

Figure 1:
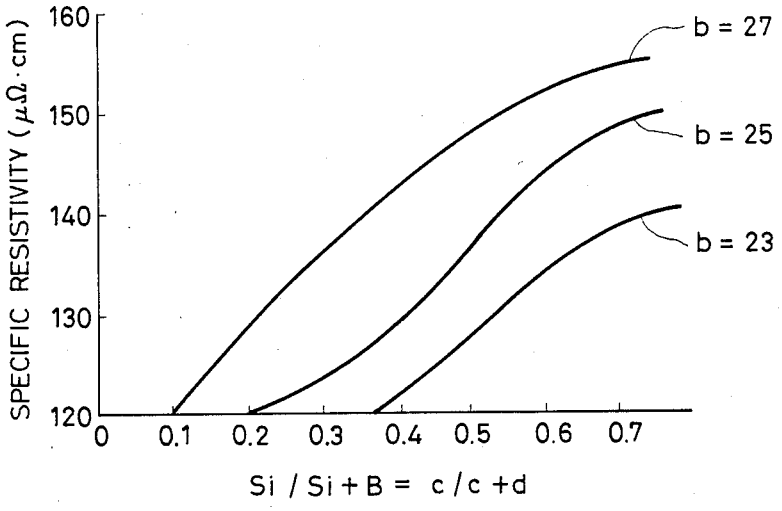

The main alloy according to this invention is represented by the formula: $(Fe_{1-a}, Co_a)$ 100 h $(Si_c, B_d)_b$ in which h, c and d are particularly limited. Then, in the alloy according to this invention, secondary phase particles are uniformly dispersed in a three-dimensional manner into an alloy matrix prepared by adding from 1.0 to 2.0 atom % Cr and from 0 to 4.0 atomic % Ru to the main alloy. In the formula a is usually from 0.93 to 0.95 for reducing the magnetic distortion to zero.

The composition in the main alloy is restricted for the reasons described below. The value for b represents the density of the metalloids (Si, B). If b exceeds 27 atm%, the saturation magnetic flux density becomes undesirably low for use in magnetic heads. While on the other hand, if the metalloid density is lower than 20 atm%, the magnetic permeability is reduced and the formation of a uniform amorphous alloy is made difficult. Further, at least 23 atm% metalloid density is required in order to stably obtain an amorphous thin plate with a thickness of more than 40 μm.

Description will now be made more specifically to examples of the main alloy according to this invention.

EXAMPLES OF MAIN ALLOY

Thin film ribbons of amorphous alloys having the compositions as shown in the below Table were prepared according to a single wall liquid quenching process. Specifically, molten metal is jetted out under the pressure of an argon gas from a quartz nozzle onto a rotating copper roll.

Roll rotation was from 500 to 2000 rpm and the pressure of the jetting gas was from 0.1 to 1 kg/cm$^2$. The thus prepared film ribbon had a width of about 25 mm, a thickness of from 32 to 49 um and a length of about 20 to 30 m. It was confirmed that all of the prepared film ribbons were in the amorphous phase by X-ray diffraction and the magnetic distortion was substantially zero being as low as the $10^{-6}$ order. The crystallization temperature was determined by using a differential scanning type calorie meter (DSC). The thickness was measured by a micrometer. The magnetic permeability was measured through the inductance method by applying windings (each 20 turns on primary and secondary sides) around 10 sheets of loosely stacked rings each of 10 mm outer diameter and 6 mm inner diameter prepared from the film ribbon through punching. The magnetic permeability was measured at room temperature for the rings prepared from the liquid-quenched film ribbons and for rings that were annealed (water hardening after retaining at 100° C.–500° C. for 10 minutes, with the retention temperature at 10° C. step).

The effective magnetic permeability at 3 mOe and 1 KHz was employed as the initial magnetic permeability. The saturation magnetization ($\rho s$) was measured under the magnetic field of 10 KOe by VSM. The specific resistivity was measured by the four terminal method.

TABLE

| | Si + B density (atm %) | Si / Si + B | Film thickness t (μm) | Saturation magnetization σ s (emu/g) |
|---|---|---|---|---|
| (1) $Co_{65.6}Fe_{4.4}Si_{5.4}B_{21.6}$ | 27 | 0.20 | 37 | 84.7 |
| (2) $Co_{68.6}Fe_{4.4}Si_{10.8}B_{16.2}$ | 27 | 0.40 | 35 | 78.4 |
| (3) $Co_{68.6}Fe_{4.4}Si_{13.5}B_{13.5}$ | 27 | 0.50 | 39 | 75.4 |
| (4) $Co_{68.6}Fe_{4.4}Si_{17}B_{10.0}$ | 27 | 0.63 | 43 | 73.1 |
| (5) $Co_{68.6}Fe_{4.4}Si_{19}B_{6.0}$ | 27 | 0.70 | 41 | 69 |
| (6) $Co_{69.6}Fe_{4.4}Si_{5.2}B_{20.5}$ | 26 | 0.20 | 33 | 92 |
| (7) $Co_{69.6}Fe_{4.4}Si_{13}B_{13}$ | 26 | 0.50 | 44 | 82 |
| (8) $Co_{69.6}Fe_{4.4}Si_{16}B_{10}$ | 26 | 0.62 | 33 | 78 |
| (9) $Co_{69.6}Fe_{4.4}Si_{17}B_{9}$ | 26 | 0.65 | 40 | 76 |
| (10) $Co_{69.6}Fe_{4.4}Si_{18}B_{8}$ | 26 | 0.69 | 39 | 76 |
| (11) $Co_{70.5}Fe_{4.5}Si_{5}B_{20}$ | 25 | 0.20 | 45 | 92 |

TABLE-continued

| | Si + B density (atm %) | Si / Si + B | Film thickness t (μm) | Saturation magnetization σ s (emu/g) |
|---|---|---|---|---|
| (12) $Co_{70.5}Fe_{4.5}Si_{10}B_{15}$ | 25 | 0.40 | 40 | 89 |
| (13) $Co_{70.5}Fe_{4.5}Si_{12.5}B_{12.5}$ | 25 | 0.50 | 37 | 84 |
| (14) $Co_{70.5}Fe_{4.5}Si_{15}B_{10}$ | 25 | 0.60 | 39 | 83 |
| (15) $Co_{70.5}Fe_{4.5}Si_{16}B_{9}$ | 25 | 0.64 | 49 | 81 |
| (16) $Co_{70.5}Fe_{4.5}Si_{17}B_{8}$ | 25 | 0.68 | 47 | 79 |
| (17) $Co_{71.1}Fe_{4.9}Si_{4.2}B_{19.8}$ | 24 | 0.18 | 35 | 99 |
| (18) $Co_{71.1}Fe_{4.9}Si_{12}B_{12}$ | 24 | 0.50 | 34 | 93 |
| (19) $Co_{71.1}Fe_{4.9}Si_{13}B_{9}$ | 24 | 0.63 | 44 | 88 |
| (20) $Co_{71.1}Fe_{4.9}Si_{16}B_{8}$ | 24 | 0.67 | 45 | 80 |
| (21) $Co_{72.4}Fe_{4.6}Si_{4.6}B_{18.4}$ | 23 | 0.20 | 33 | 105 |
| (22) $Co_{72.4}Fe_{4.6}Si_{11.5}B_{11.5}$ | 23 | 0.50 | 32 | 95 |
| (23) $Co_{72.4}Fe_{4.6}Si_{13.8}B_{9.2}$ | 23 | 0.60 | 40 | 92 |
| (24) $Co_{72.4}Fe_{4.6}Si_{15}B_{8.9}$ | 23 | 0.65 | 32 | 90 |

FIG. 1 shows the relationship between the specific resistivity $\rho$ and c/c+d. In the range: b=23–27 atm%, $\rho$ goes higher as c/c+d is increased.

Figure 2:
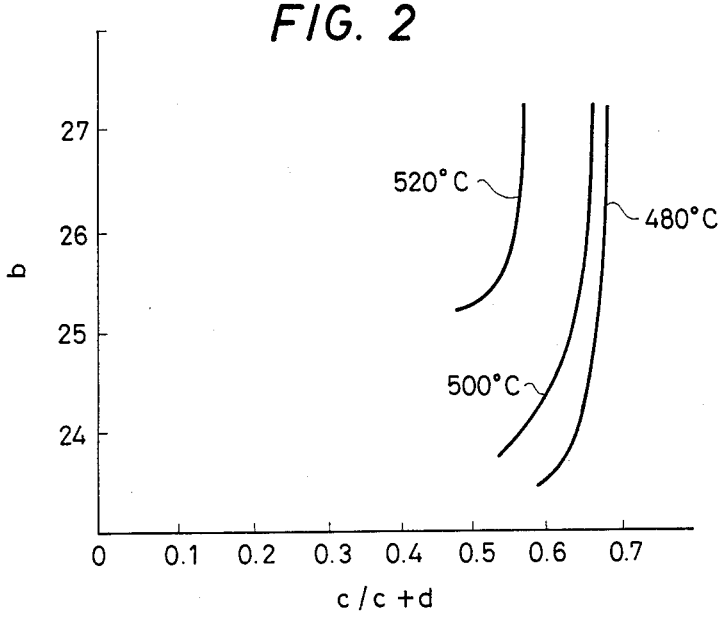
FIG. 2 is a diagram showing the relationship between B(=Si+b) and c/c+d for various crystallization temperatures.

FIG. 2 shows the effect of b and c/c+d on the crystallization temperature. While there have been many reports on this relationship, abrupt changes in the crystallization temperature were found according to our experiment at c/c+d near about 0.65. Specifically, the crystallization temperature becomes low at c/c+d>0.65. The fact is different from those reported previously.

Figure 3:
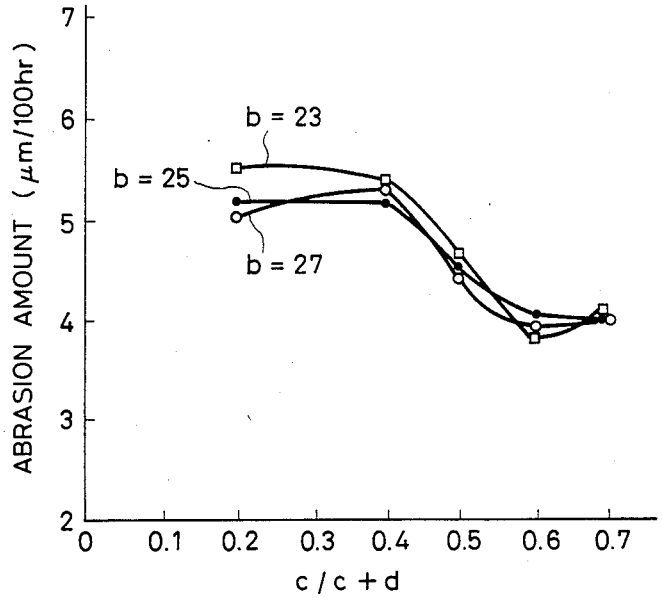
FIG. 3 is a diagram showing the relationship between the abrasion amount per 100 hours and c/c+d.

FIG. 3 shows the relationship between the abrasion amount per 100 hr and c/c+d. The abrasion amount was measured by preparing an ordinary audio type magnetic head from liquid-quenched amorphous samples, mounting it to a commercial cassette deck and then using commercial normal tapes. It can be seen that the abrasion amount is substantially constant within a range for c/c+d of between 0.2–0.4, gradually lowered as the ratio exceeds 0.4 and substantially saturated at a ratio greater than 0.55. It can thus be seen that a satisfactory abrasion resistance can be obtained at the ratio of c/c+d greater than 0.55.

Figure 4:
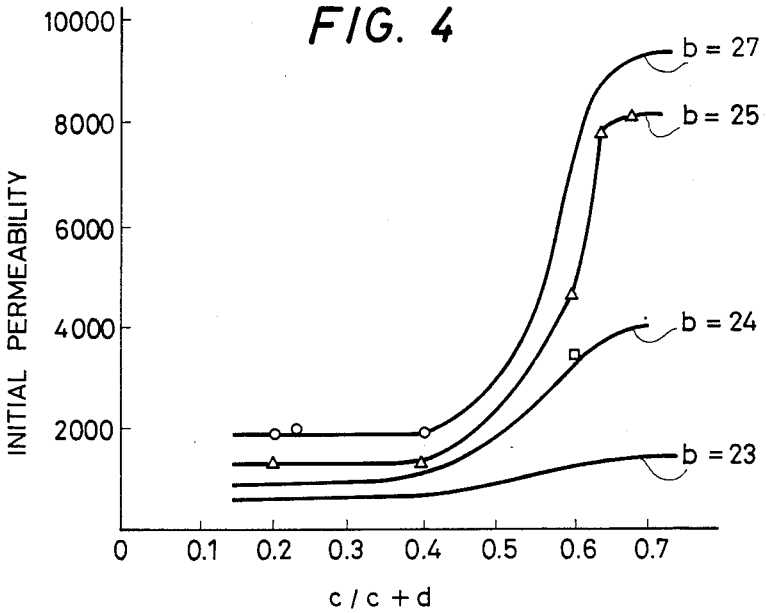
FIG. 4 is a diagram showing the relationship between the initial permeability $\mu i$ and c/c+d in the amorphous alloy.

FIG. 4 shows the relationship between the initial permeability $\mu i$ and c/c+d of amorphous alloys of various compositions quenched from liquid. In any of the cases, while the value $\mu i$ varies as b changes, it takes a constant level at the ratio c/c+d of less than 0.4, rapidly increases at 0.4–0.6 and gradually approaches a higher constant value. That is, when the alloy is left as it is after the liquid quenching, $\mu i$ becomes higher as c/c+d becomes greater. More desirably, c/c+d is higher than 0.55.

It has been generally known that the magnetic permeability of amorphous magnetic alloys can be improved by annealing under an appropriate condition. In view of the above, the effect of the annealing on the magnetic permeability was examined.

Figure 5:
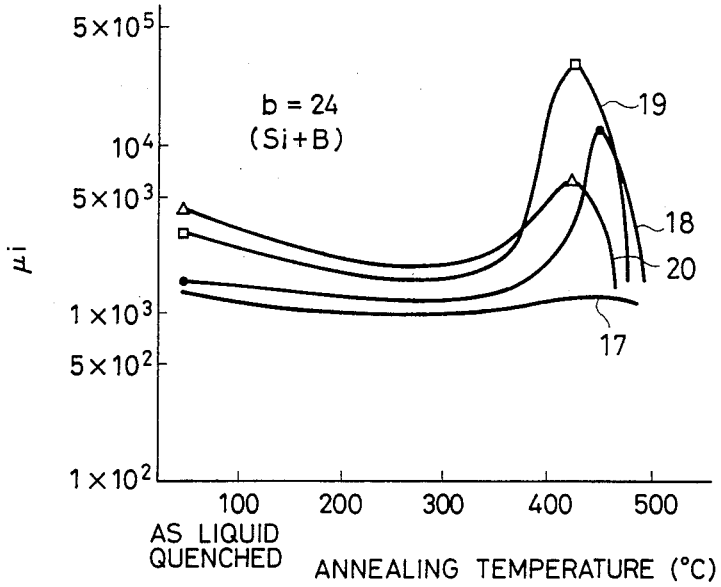
FIG. 5 through FIG. 7 are, respectively, diagrams showing the relationship between the initial permeability and the annealing temperature for respective values b.

FIG. 5 shows a relationship between the initial magnetic permeability and annealing temperature wherein amorphous alloys (No. 17–20 of the table) having various compositions for c/c+d at b=24 are annealed for 10 minutes at various temperatures, subjected to water hardening and measured in that state. The effect of the annealing temperature on the initial magnetic permeability is similar in amorphous alloys of various compositions, in which a higher $\mu i$ is obtained at c/c+d of 0.5–0.63 and it has been confirmed that the improvement in the initial magnetic permeability by the annealing is significant in these compositions. When the maximum values for $\mu i$ in the respective samples were compared after annealing under various conditions, the ratios c/c+d were arranged in the higher order of $\mu i$ as: 0.63, 0.50, 0.67 and 0.18 (for No. 17–20).

Figure 6:
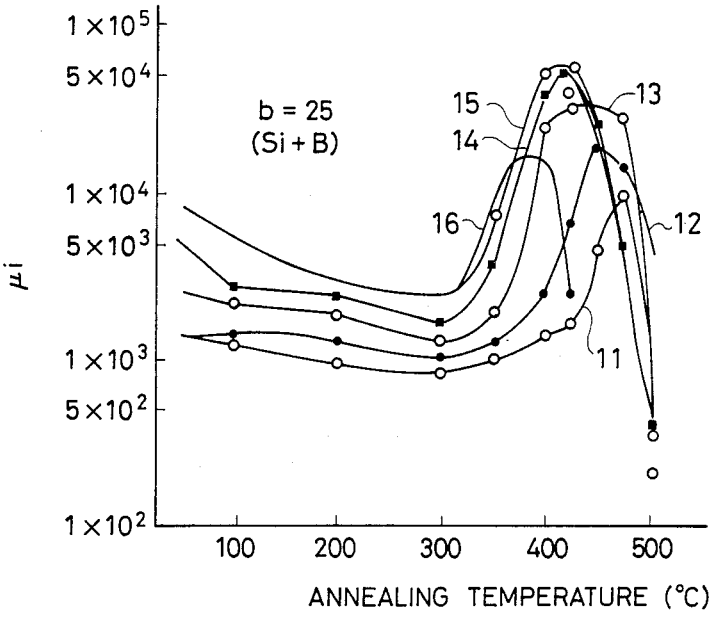

FIG. 6 shows the result of the examination for the effect of the heat treatment on the value $\mu i$ in the case of b=25 in the same manner as in FIG. 5. Maximum values for $\mu i$ in each of the samples after annealing under the various conditions were compared and the ratios c/c+d were arranged in the higher order of $\mu i$ as: 0.64, 0.60, 0.50, 0.40, 0.68, 0.20 (for No. 1–16).

Figure 7:
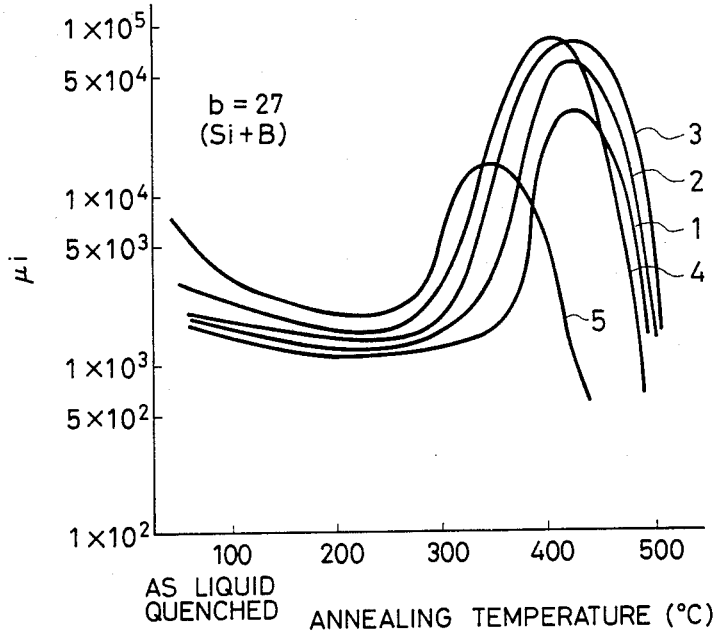

FIG. 7 shows the result of the examination for the effect of the heat treatment on the value $\mu i$ in the case of b=27 in the same manner as in FIG. 5. Maximum values for $\mu i$ in each of the samples after annealing under the various conditions were compared and the ratios c/c+d were arranged in the higher order of $\mu i$ as: 0.63, 0.50, 0.40, 0.20, 0.76 (for No. 1–5).

Figure 8:
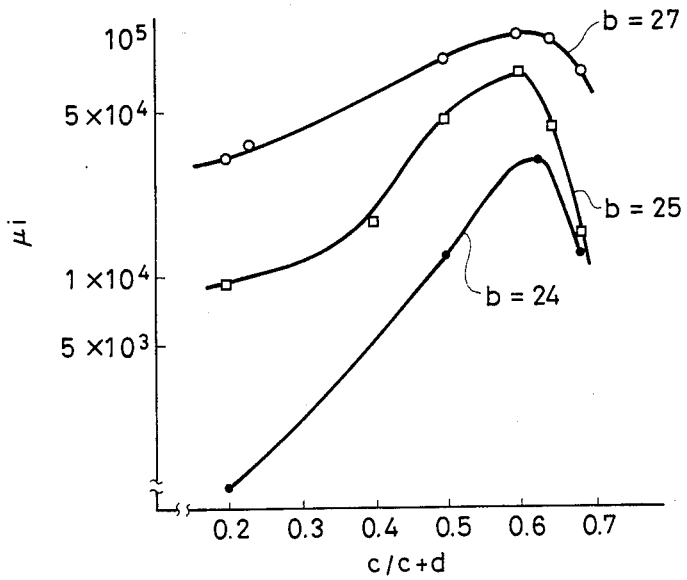
FIG. 8 is a diagram showing the relationship between $\mu i$ and c/c+d.

FIG. 8 shows the relationship between the maximum value of $\mu i$ obtained for various compositions after annealing and c/c+d. $\mu i$ takes the largest value at the ratio c/c+d of about 6 in any case of b=24, 25, 27.

Further, scattering in the properties have to be taken into consideration in view of using them as practical materials. For example, a high permeability obtainable in a broad range of heat treating temperature can improve the workability and mass producibility or the reliability of the material in view of the procedures for the heat treatment.

Figure 9:
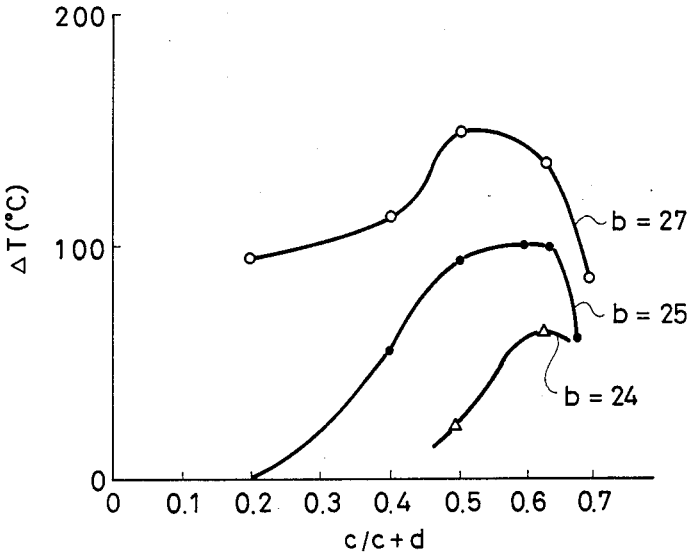
FIG. 9 is a diagram showing the relationship between the range of the annealing temperature and c/c+d capable of obtaining value $\mu i > 10^4$.

FIG. 9 shows the range of the annealing temperature ($\Delta T$), at which the value $\mu i > 10^4$ can be obtained. It is considered that the value The $\mu i = 10^4$ substantially corresponds to a value required as the head core material. $\mu i$ for the permalloy and sendust used at present as the head core material approximately corresponds to this value. While $\Delta T$ increases as b is greater, the saturation magnetic density is lower. The curves at b=24, 25, 27 are similar to each other and $\Delta T$ takes a great value for each of values b at c/c+d between about 0.5–0.65.

Further, the alloys (1)–(24) were left in air at high humidity and the surface state was observed to examine the corrosion resistivity. The corrosion resistivity was better as c/c+d was greater irrespective of the values for b.

The foregoing descriptions can be summarized as below.

In order to satisfy all of the conditions for:

| | |
|---|---|
| Specific resistivity $\rho$ | c/c + d → greater |
| Crystallization temperature | c/c + d < 0.65 |
| Abrasion resistance | 0.55 < c/c + d |
| ui (AsQ) | 0.55 < c/c + d < 0.65 |
| ui (after heat treatment) | 0.50 < c/c + d < 0.65 |
| ui ($\Delta T$) | 0.5 < c/c + d < 0.65 |
| Corrosion resistivity | c/c + d → greater, |

it is necessary:

$$0.55 < c/c+d < 0.65$$

Then, Cr and Ru elements were added to the main alloy as described above. The alloys incorporated with these elements were prepared in accordance with the single roll liquid-quenching method in the same manner as for the main alloy described above.

Cr is added for improving the corrosion resistivity and it is added by from 1.0 to 2.0 atm% to the main alloy. The alloy after the addition was subjected to saline water spray test (at 40° C., for 48 hours) and observed externally to find that a sufficient corrosion resistivity was obtained. If the addition amount is less than 1.0 atm%, no substantial effect was obtained. While on the other hand, if it exceeds 2.0 atm%, the saturation magnetic flux density was reduced. Further, addition of Cr also provided an effect that the alloy was not fragile even after the heat treatment.

If the addition amount for Ru is larger, the abrasion resistance can be improved further but if it exceeds 4.0 atm%, the amorphous state of the alloy is difficult to attain and the punching workability is worsened.

Figure 10:
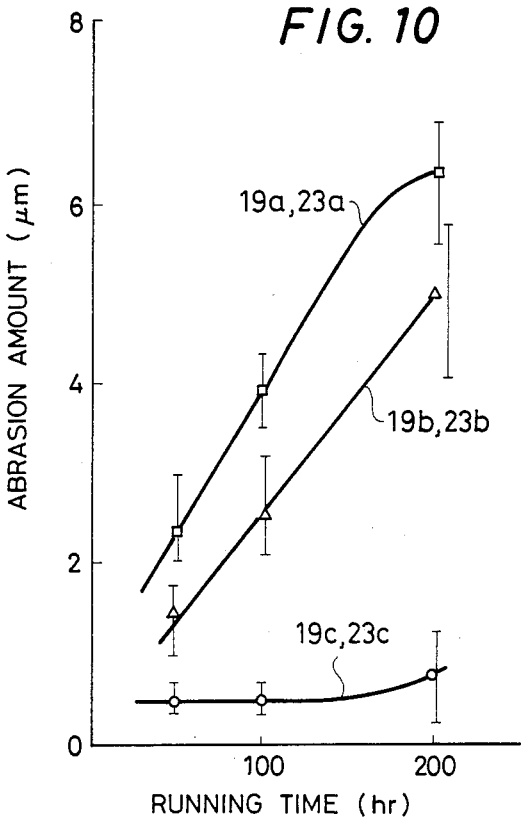
FIG. 10 is a diagram showing the relationship between the amount of added Ru and the abrasion amount per hour.

FIG. 10 is a graph representing the abrasion amount ($\mu$m) relative to the running time (hr) of the main alloy composition samples (No. 19, 23) shown in the table above, to which are previously added 1.5 atm% Cr and, further, 1.0 atm% or 3.0 atm% Ru. In the figure, 19*a* represents the state where Cr is added solely by 1.5 atm% to the main alloy composition sample (No. 19), 19*b* represents the state where Cr is added by 1.5 atm% and Ru is added by 3.0 atm% to the sample (No. 19), 19*c* represents the state where Cr is added by 1.5 atm% and Ru is added by 3.0 atm% to the sample (No. 19) respectively. In the same manner, 23*a* represents the case where Cr is added solely by 1.5 atm% to the main alloy composition sample (No. 23), 23*b* represents the state where Cr is added by 1.5 atm% and Ru is added by 1.0 atm%, and 23*c* represents the state where Cr is added by 1.5 atm% and Ru is added by 3.0 atm%. As apparent from the graphs, there is no difference in the abrasion resistance between 19*a–c* and 23*a–c*, and the abrasion amount is significantly reduced as the addition amount of Ru is increased in any of the main alloy compositions.

The situation that the amount of Si and B in the main alloy as described above may satisfy the condition: $0.55 < c/c+d < 0.65$ regarding the improvement in the properties such as specific resistivity $\rho$, $\mu i$, etc. is not changed by the addition of the Cr and Ru elements.

Then, in the amorphous alloy according to this invention, Cr and Ru elements are added to the main alloy and second phase particles are further dispersed in the alloy matrix.

A method of preparing amorphous alloy in which the second phase particles are uniformly dispersed into the alloy matrix is to be described. After heating to melt the alloy material constituting the alloy matrix at first, the second phase particles are sprayed to disperse together with a spraying medium composed of an inert gas such as argon before the alloy material solidifies and, thereafter, they are solidified to prepare an ingot containing the second phase particles. After melting the ingot again to such an extent as the second phase particles are not dissolved, it is quenched rapidly to solidify by the single roll liquid quenching process, by which the second phase particles can uniformly be dispersed in a 3-dimensional manner into the alloy matrix.

As an example of this invention, an amorphous alloy of the following composition (a) was prepared in which 2 vol% $Al_2O_3$ was dispersed into the alloy matrix. Further, an amorphous alloy of the following composition (b) in which no $Al_2O_3$ was dispersed was also prepared as an comparative example.

$$Co_{69.6}Fe_{4.5}Si_{14.5}B_{9.0}Cr_{1.5}Ru_{1.0} + 2\ vol\%\ Al_2O_3 \quad (a)$$

(b) $Co_{69.5}Fe_{4.5}Si_{14.5}B_{9.0}Cr_{1.5}Ru_{1.0}$ (a)

It was confirmed by a scanning type electron microscope that the $Al_2O_3$ particles were dispersed in the amorphous alloy matrix in a uniform three-dimensional manner.

Figure 11:
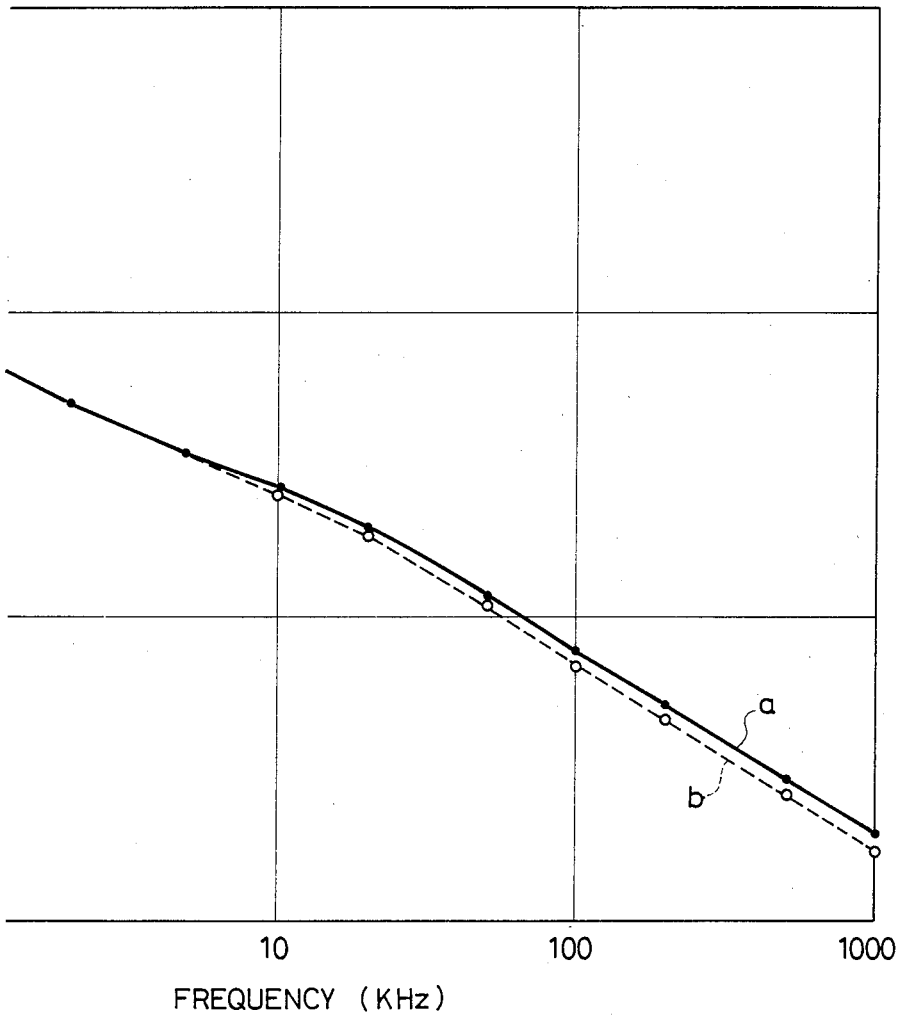
FIG. 11 is a diagram showing the relationship between the effective permeability $\mu e$ and the frequency in the amorphous alloy depending on the presence or absence of $Al_2O_3$ addition.

FIG. 11 shows the change of the effective magnetic permeability $\mu e$ of the alloys (a), (b) relative to the frequency. As can be seen from the graph, reduction in the effective magnetic permeation, particularly, in the high frequency region is smaller in the alloy (a) in which $Al_2O_3$ is dispersed, as compared with the alloy (b) where it was not dispersed.

Second phase particles usable herein include, in addition to $Al_2O_3$, those oxides having no compatibility with the alloy matrix such as $Fe_2O_3$ and $SiO_2$, carbon or carbon compounds such as C, Wc, TiC, NbC, metal or alloy of Ti, Mo and W, as well as composite products thereof.

Referring to the addition amount of the second phase particles, it is less diffusible in the amorphous alloy in excess of 3.0 vol% and no substantial effect can be obtained below 0.5 vol%.

What is claim is:

1. An amorphous alloy for use in magnetic heads, wherein 1.0–2.0 atm% Cr and an amount up to 4.0 atm% Ru are added to an alloy having the following composition formula:

$$(Fe_{1-a}, Co_a)_{100-b}(Si_c,B_d)_b$$

where a=0.93–0.95 b=23–27 atomic % c/(c+d)=0.55–0.65.

2. An amorphous alloy for use in magnetic heads, wherein second phase particles are dispersed in an alloy matrix in which 1.0–2.0 atm% Cr and 0–4.0 atm% Ru are added in an alloy having the following composition formula:

$$(Fe_{1-a}, Co_a)_{100-b}(Si_c,B_d)_b$$

where a=0.93–0.95 b=23–27 atomic % c/(c+d)=0.55–0.65.

3. The amorphous alloy for use in magnetic heads as defined in claim 2, wherein the second phase particles are added within a range from 0.5 to 3.0 vol%.

4. The amorphous alloy for use in magnetic heads as defined in claim 2, wherein the secondary phase particles comprise $Al_2O_3$ particles.

5. The amorphous alloy for use in magnetic heads as defined in claim 3 wherein the secondary phase particles comprise $Al_2O_3$ particles.

* * * * *